US006059659A

United States Patent [19]

Busch et al.

[11] Patent Number: 6,059,659

[45] Date of Patent: May 9, 2000

[54] ROULETTE TABLE HAVING PROGRESSIVE JACKPOTS

[75] Inventors: Steven L. Busch, Liverpool, N.Y.; Charles S. Zussman, Egg Harbor Township, N.J.; Thomas R. Wein, Mason, Ohio; Stefan Giselbrecht, Graz, Austria; Peter Hödl, Graz, Austria; Franz Lechner, Graz, Austria

[73] Assignee: Las Vegas Gaming, Inc., Las Vegas, Nev.

[21] Appl. No.: 08/870,280

[22] Filed: Jun. 6, 1997

Related U.S. Application Data

[63] Continuation-in-part of application No. 08/796,527, Feb. 6, 1997

[60] Provisional application No. 60/019,321, Jun. 7, 1996.

[51] Int. Cl.[7] ..... A63F 5/00

[52] U.S. Cl. ..... 463/17; 463/25; 273/142; 273/274

[58] Field of Search ..... 463/16, 17, 25, 463/26, 27; 273/142 B, 142 F, 142 E, 274, 142 R, 309

[56] References Cited

U.S. PATENT DOCUMENTS 5,042,810 8/1991 Williams ..... 273/142
5,299,803 4/1994 Halaby ..... 273/148
5,364,104 11/1994 Jones et al. ..... 273/292
5,377,973 1/1995 Jones et al. ..... 273/292
5,393,067 2/1995 Paulsen et al. ..... 273/309
5,540,442 7/1996 Orselli et al. ..... 273/274
5,588,650 12/1996 Eman et al. ..... 273/142
5,626,341 5/1997 Jones et al. ..... 273/292
5,707,287 1/1998 McCrea, Jr. ..... 463/27

*Primary Examiner*—Michael O'Neill
*Assistant Examiner*—John M Hotaling, II
*Attorney, Agent, or Firm*—J. David Welsh

[57] ABSTRACT

Method of playing roulette with a system including a roulette wheel, a conventional betting layout and a progressive jackpot layout. Players make wages on the conventional layout and/or the progressive layout to participate in a progressive jackpot game wherein the jackpot is accumulated from losing wagers on the progressive jackpot layout. The system includes sensors for detecting chips placed on the progressive layout. The jackpot is won by a wagered winning number being selected by the roulette wheel in a predetermined number of successive spins.

29 Claims, 12 Drawing Sheets

222
214
216
220
212
204
210
202
$987654.00
$7777.00
$222.00
9
218
208
402
D
36 35 34 33 32 31 30 29 28 27 26 25 24 23 22 21 20 19 18 17 16 15 14 13 12 11 10 9 8 7 6 5 4 3 2 1 00 0
2 TO 1
2 TO 1
2 TO 1
36 33 30 27 24 21 18 15 12 9 6 3
35 32 29 26 23 20 17 14 11 8 5 2
34 31 28 25 22 19 16 13 10 7 4 1
00
0
1 OF 12
1 OF 12
1 OF 12
18 OF 36
ODD
EVEN
1 OF 18

10
26
14
36
20
RAM
CPU
16
D
28
18
48
2
4
$58,486
26
6
OS
22
9
8
VI
VI
0 1 2 3 4 5 6 7 8 9 10 11 12 13 14 15 16 17 18
00 19 20 21 22 23 24 25 26 27 28 29 30 31 32 33 34 35 36
00 3 6 9 12 15 21 24 27 30 33 36 39
0 2 5 8 11 14 20 23 26 29 32 35 38
1 4 7 10 13 16 19 22 25 31 34 37
2 TO 1
2 TO 1
2 TO 1
1 OF 12
1 OF 12
1 OF 12
1 OF 18
EVEN
ODD
18 OF 36

ROULETTE TABLE HAVING PROGRESSIVE JACKPOTS

CROSS-REFERENCE TO RELATED APPLICATIONS

This application claims the benefit of U. S. Provisional Application Ser. No. 60/019,321, filed Jun. 7, 1996, and is a continuation-in-part of U.S. patent application Ser. No. 08/796,527, filed Feb. 6, 1997. U.S. patent application Ser. No. 08/796,527, filed Feb. 6, 1997 also claims the benefit of U.S. Provisional Application Ser. No. 60/019,321, filed Jun. 7, 1996. U.S. Provisional Application No. 60/019,321, filed on Jun. 7, 1996, and U.S. patent application Ser. No. 08/796,527, filed Feb. 6, 1997 are incorporated herein by reference.

BACKGROUND OF THE INVENTION

1. Field of the Invention

This invention relates to a method and system for operating a roulette table. More specifically, the present invention relates to a method and system for operating a roulette table having progressive jackpots.

2. Description of the Prior Art

Roulette equipment typically comprises a table upon which is horizontally mounted a well-balanced, compartmented wheel which is spun by a croupier or dealer. The wheel is rotated in one direction and opposite to its rotation the dealer throws a small ball which comes to rest in one of a set of numbered compartments when the wheel slows to a sufficiently low speed. The rotations of the wheel and ball result in a winning number registered by the ball resting in one of the numbered compartments at the rim of the wheel. Bets on a number or set of numbers on the wheel and table layout are typically made by players using chips. A different chip color may be assigned to each player, the chips may have cash values of different denominations, and may be limited to use only on the issuing table.

Casino card systems, wherein a jackpot progressively accumulates to stimulate greater interest by players, are well known in the art. The prior art relating to progressive jackpot gambling systems includes, U.S. Pat. No. 4,861,041 which discloses a method and apparatus for playing a casino card game such as Poker and Twenty-One having a progressive jackpot component. In the '041 patent, the winning jackpot hands are preselected or predetermined by the house.

U.S. Pat. No. 5,280,909 discloses a gaming system with a progressive jackpot. The disclosure involves the use of a plurality of gaming machines. The machines are linked together electronically so that in regular play on the machines, players may compete for an additional common award or jackpot. An electronic computer controller determines the selection of the winning jackpot number. The disclosed gaming machines are essentially coin operated slot machines having unspecified operational parameters.

U.S. Pat. No. 5,042,810 discloses casino roulette apparatus using a chip counter to aid in accumulating a jackpot, and a display means for showing the value of a jackpot fund which increases as play progresses. A jackpot is paid out according to a prescribed criteria. The value of the jackpot accumulated is based on the turnover of the roulette table. In other words, the value amount accumulating in the jackpot from game to game is determined and controlled by the house as a function of the total value amount wagered on each roulette game played. Each spin of the wheel and ball constitutes a game. The house may alter and control a specific and particular fraction of "table turnover" (or total monies taken in by the house on each game) introduced into the jackpot as a function of the duration of game play, the total wagers per game and the frequency of jackpot wins.

In playing roulette in the casino according to U.S. Pat. No. 5,042,810, players are given colored chips or small disks when they purchase them from the house to play. They thus "buy into" a game. Different colors are provided to each player. In U.S. Pat. No. 5,042,810, specific numbers are allocated or assigned by the house with or to each color. For example, red is preassigned the numbers 1, 6, 14 and 18. A player becomes eligible to win a jackpot when a number included within the set of numbers associated with that specific color the player plays with is selected by the wheel and ball three or four times in succession. Thus, if the number 6 is selected by the roulette wheel action, and 6 is associated with the color red, then the player eligible to win a jackpot is identified. The player who is playing with red chips. Furthermore, in U.S. Pat. No. 5,042,810 there is only one possible winner in each jackpot. Players have no choice regarding which numbers they desire to play for the jackpot except by asking for a particular color, which may not be an option. Additionally, the game described by U.S. Pat. No. 5,042,810 appears to be inherently unfair to some players since a player who bets substantially more than other players on a consistent basis inequitably contributes more to the jackpot fund than do the players who bet a lesser amount on the average. Furthermore, since the house is obliged to pay out a portion of its winnings to a jackpot fund, it may be motivated to attempt to increase the volume of play to enable the redemption of monies lost as a result of jackpot contributions for the house.

U.S. Pat. No. 5,540,442 discloses roulette apparatus having a random number generator, a conventional wheel and a secondary playing layout on the table surface. A bet on the secondary layout is won when the numbers on the conventional wheel and the random number generator match.

There is a desire in the casino industry for a roulette system that offers greater possibility for rewards, and that is interesting for the player; but also is easy and economical for the casino management to operate, and is within the scope of the rules and regulations of various government jurisdictions.

It is believed that prior art systems having a form of a progressive jackpot fund have not captured the attention of the casino customer because the prior systems select and assign number(s) or other jackpot goals to the players.

On the other hand, the present invention gives the players greater control in the selection, betting and payout process. The present invention provides roulette apparatus having progressive jackpot accumulations wherein each player alone may select a potential winning jackpot number.

To achieve the foregoing and other objects and advantages, a principle object of our invention is to offer to the casino industry apparatus for operating a roulette table having progressive jackpots that is more exciting for players, easier and of greater cost efficiency for casino management to operate, and existing conventional tables are easily convertible into a table embodying the present invention.

It is a further object of our invention to provide a roulette table wherein players have a personal choice regarding their wager on a number in progressive jackpot roulette game.

SUMMARY OF THE INVENTION

In accordance with a broad aspect of the present invention, there is provided a method of playing roulette with a system including (i) means for selecting a number from a predetermined group of numbers, (ii) a first betting layout for playing a conventional game of roulette, the first betting layout having thereon a plurality of numbers corresponding to the predetermined group of numbers, and (iii) a second betting layout for playing a progressive jackpot game, the second layout having thereon the same plurality of numbers as are on the first betting layout. The method comprises the steps of the players making wages on the first betting layout to participate in a conventional game of roulette, and/or on the second betting layout to participate in a progressive jackpot game wherein the jackpot is won by the same wagered winning number being selected by the number selecting means for a predetermined number of successive operations of the number selecting means. The number selecting means is operated to select a winning number. A jackpot fund is accumulated from a portion of the wagers, and winning wages on the first betting layout for conventional roulette are paid.

The foregoing steps are repeated until the same wagered winning progressive number comes up for the predetermined number of successive operations of the number generating means, whereupon the jackpot fund is paid out.

It is preferred that the played progressive number is selected by the number selecting means three consecutive times to win the jackpot. Three consecutive games provides an opportunity for the jackpot to build up.

Also, it is preferred that a winning progressive jackpot wager on the second betting layout is marked, and that the marked number on the progressive jackpot layout is not again wagered until a different number is generated by the number selecting means to break the order of successive same number winnings or until the jackpot is won by the same winning number coming up for the predetermined number of successive operations of the number selecting means. Otherwise, in one form of the invention a subsequent bettor on a marked number would not initially be eligible for jackpot accumulations until after the first bettor on the marked number has won. However, it is understood that the progressive jackpot game can be played with winning jackpot distribution(s) made when and however defined by the house rules for the game. The latter including same number progressive jackpot betting on the second betting layout even on a number that has won one or more consecutive times, and with jackpot distributions made in accordance with the house rules.

It is also preferred that only players playing in the conventional game of roulette by wagering on the first betting layout are permitted to optionally play in the progressive jackpot game by wagering on the second betting layout. Further, it is preferred that the jackpot fund be accumulated solely from wagers made on the second betting layout.

In accordance with another broad aspect of the present invention, there is provided a system for playing roulette comprising (a) a roulette table including (i) means for selecting a number from a predetermined group of numbers, preferably a roulette wheel and ball, (ii) a conventional betting layout with a plurality of numbers thereon corresponding to the numbers on the roulette wheel, and (iii) a progressive jackpot betting layout having thereon the same plurality of numbers as are on the conventional betting layout. The roulette wheel and ball are operated by a dealer to play a conventional game of roulette on the conventional betting layout, and to play a separate progressive jackpot game on the progressive jackpot betting layout wherein a jackpot is won by a wagered number winning on a predetermined number of successive spins of the wheel. The system also includes means for generating signals representative of numbers bet on the progressive jackpot betting layout, means responsive to the generating means for indicating bet progressive jackpot numbers and means for sensing the winning number in each spin of the wheel. Means are used for marking a winning bet number on the progressive jackpot betting layout to prevent the marked number on the progressive jackpot betting layout from being further wagered until a different number wins to break the order of successive same number winnings or until the jackpot is won by the same bet number winning for the predetermined number of successive spins of the wheel. The system also has means including a computer responsive to the generating means, and the sensing means for accumulating a jackpot fund from the amount wagered on the progressive jackpot betting layout, and for determining when the same bet number wins for the predetermined number of successive spins of the wheel. Means are preferably connected to the computer for displaying the amount of money in the jackpot fund, and the number of successive same number winnings.

As used herein "means for selecting a number from a predetermined group of numbers" includes a typical roulette wheel and ball operated by a dealer, and any automatic device which may have mechanical, electrical and/or computer components such as the random number generator of U. S. Pat. No. 5,540,442 which selects and displays one of the typical roulette numbers.

In the various embodiments of the invention, bets may be initially made or placed on either the conventional or progressive jackpot betting layouts. However as noted above, it is preferred that players be required to first wager on the conventional betting layout before wagering in the progressive phase of the instant game of roulette. The player then places a single chip on any one of the numbers on the progressive jackpot layout. Alternatively, the player may deliver a chip by hand to the dealer and indicate verbally the selected number to the dealer, and the dealer then places the chip on the player's selected number on the progressive jackpot betting layout.

In still another more complex embodiment, a player inserts a single chip in a designated slot on the table felt. The slot is associated with mechanical, electrical, infrared, weight or other means, or combinations thereof to detect the chip and signal to the dealer and/or to a computer that a chip has been played. This action indicates the player's participation in the progressive part of the game.

If the next spin of the wheel results in the wheel selecting the same progressive jackpot layout number as it did in the previous spin, a fixed small cash payout (e.g., $100.00) may optionally be awarded to the player who bet on that number.

The present invention is suitable not only for live casino games but also for electronic games and/or combinations of live game and electronic game play. Namely, all or some of the functions of the dealer and the house can be performed by electronic means, with the player allowed to make individual selections of numbers on the conventional and progressive jackpot layouts.

The game is adaptable to a computerized electronic game and inter-active multimedia format, and is also adaptable to computer network or Internet operations.

Also, existing conventional tables are readily convertible for use in the present invention by adding a progressive jackpot betting layout to the top of the table, and by locating remaining components beneath or elsewhere on the table.

For a better understanding of the invention, its operating advantages and the specific objects attained by its uses, reference to the accompanying drawings and descriptive matter is made in which there are illustrated preferred embodiments of the invention.

DESCRIPTION OF THE SPECIFIC EMBODIMENTS

Figure 1:
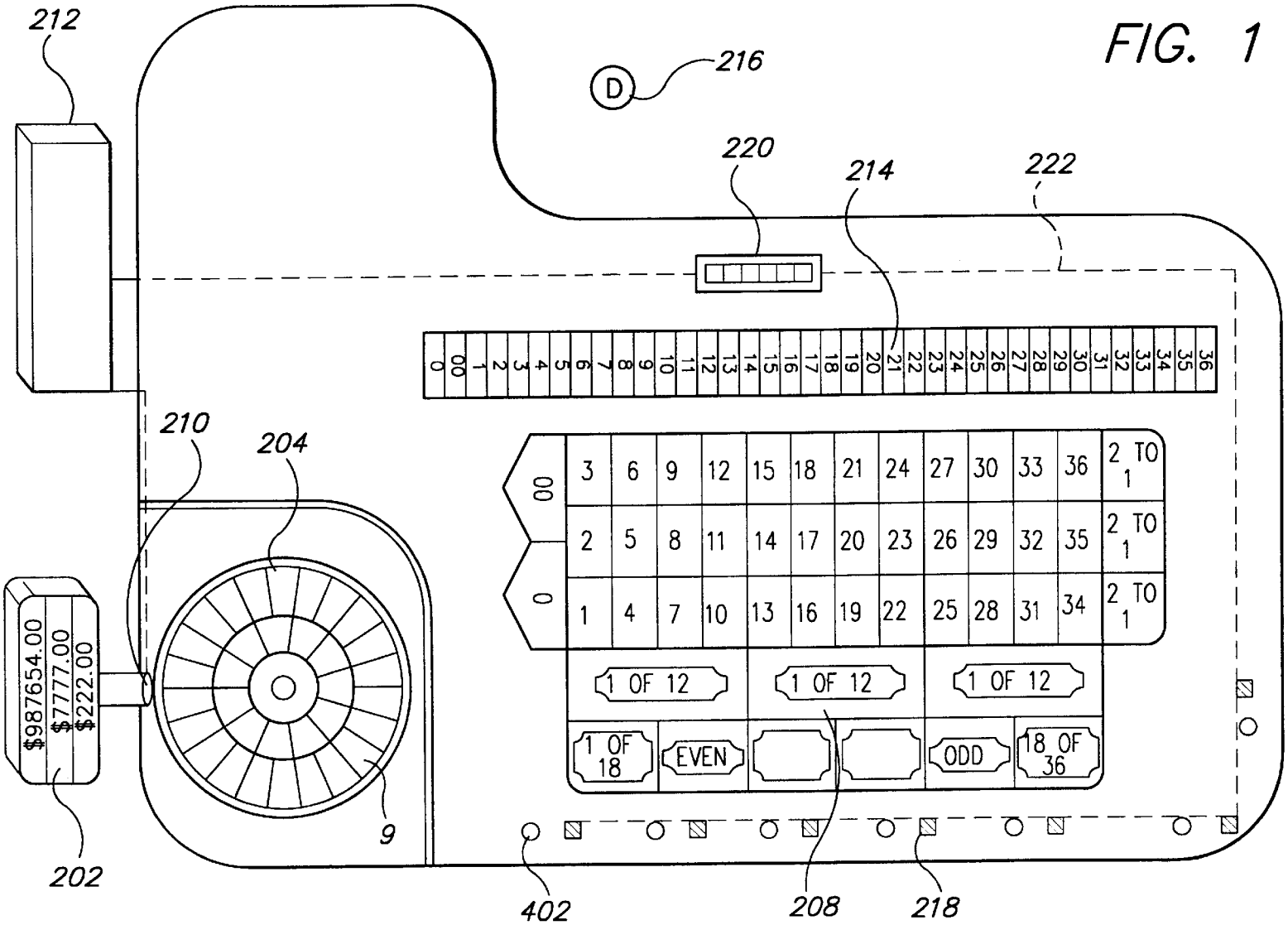
FIG. 1 is a top view of one embodiment of the present invention with apparatus of operating a roulette table to play a progressive jackpot roulette game.

With reference to FIG. 1, there is shown a roulette table in accordance with the present invention comprising a wheel 204 and a conventional betting layout 208 (also known as a register, board or chart) wherein in addition to the conventional betting layout 208, a progressive jackpot betting layout 214 typically smaller in size of the conventional betting layout is placed on the table felt. The dealer is located at position 216, and the players take positions across the table from the dealer in front of slots 218.

The wagering layouts 208,214 are conventionally placed on the felt by a screen printing method. However, other methods of adhering the smaller progressive jackpot layout 214 may be used. For example, a Velcro type of attachment may be employed. Further, the progressive jackpot layout 214 need not be a design shown in FIG. 1. It may have other shapes and designs such as a race track design. A primary consideration is that in the design selection, it should be such that the dealer is able to efficiently clear the progressive jackpot number layout of losing bet chips without interfering with the chips or indicator markers placed on the winning numbers.

In accordance with the present invention, a player occupies one of a number of player positions (typically 7-positions) at the roulette table. The table also has a number of mutually distinctive sets of chips equal to the maximum number of player positions with each chip having the same value.

The player buys into the play, and the chips the player receives for the use on the conventional betting layout may have various values, but the chips used to play the jackpot games on the progressive jackpot layout typically are purchased at one dollar, and are therefore valued at one dollar, or at a unit value of any recognized currency depending upon the country in which the game is played. Such chips are well known in the art and are conventionally called "non-value" chips which are "valued" as they are purchased by the players and may be identified as "progressive chips". The chips used to play the progressive jackpot game do not have to be a base unit value, but could be a simple multiple thereof. This is to account for the different relative values of currency in the world. The value of some base units of some currencies may be extremely low relative to others, and therefore a simple multiple thereof may be employed. These chips may be used for both normal roulette play and for play in progressive jackpot play.

Each player is assigned a different one of the sets as a source of chips; and may bet the chips on one or more numbers on the conventional betting layout 208, but each player is limited to a single chip wager on each number bet on the progressive jackpot betting layout 214.

Thus in one form, each one of the mutually distinctive sets of chips has both value chips and non-value chips. Each player in this embodiment uses value chips to bet on one or more numbers on the conventional betting layout. Each player may also bet on one or more numbers on the progressive jackpot betting layout, but each player is limited to a single non-value chip wager on each number bet on the progressive jackpot betting layout 214.

Bets may be initially placed on either the conventional or progressive jackpot betting layouts. However, it is preferred that bets are initially placed on the conventional betting layout, and then on the progressive jackpot betting layout.

As noted above, it is preferred that a player enter the progressive jackpot game by simply handing the dealer a single chip, who places it on the selected number on the progressive jackpot betting layout 214. In another preferred embodiment, a player simply places a chip on the selected number. In these instances, the dealer may register the number of chips played into a keypad or input device 220 which transmits data to the computer 212 for processing. Since each player is assigned chips all having a single color or other identifying feature, the dealer knows which players are playing the progressive jackpot game.

In still another embodiment also shown in FIG. 1, a player places or inserts a single chip into a designated slot 218 located at the player's playing position on the table felt to play in the progressive jackpot game. This placement indicates participation in the progressive jackpot game and transfers to the house a specific monetary value. The slots may be operatively associated with an electric or electronic chip counter that transfers data to a computer 212.

The chip inserted into the slot 218 in the electronic device which registers this action and transmits it to the computer 212 and ultimately to a display 202 that is observable by the dealer and others. FIG. 1 represents this communication by dotted lines 222. Still further, a player may actuate a light 402 to transmit to the dealer a decision to play the progressive jackpot game. The dotted line 222 of FIG. 1 may alternately represent wireless communication such as, for example a digitally encoded electromagnetic energy signal.

After a player(s) has indicated play in the progressive jackpot and the dealer has come into possession of the progressive jackpot chip or chips, the display light 402 of FIG. 1 may be activated. The dealer then verifies that the number of chips played in the progressive game match the number of lighted indicator devices adjacent to each player's position.

Following the dealer's verification of the number and the table position of players playing the progressive game, the dealer then requests from each player who has entered the progressive jackpot game, beginning with the player to the dealer's left at the table, and continuing from player to player, left to right in succession, the number on the wheel that each player has selected for the progressive jackpot game to come up for two or more (preferably three) consecutive spins. Since the colored chips used in the progressive jackpot game are the same as the chips a player uses during regular play, the dealer can immediately recognize and identify who is playing.

Upon learning from each player what number on the wheel is being selected for the progressive jackpot, the dealer may place each player's chip on the number selected on the jackpot wagering layout 214 of FIG. 1 located on the table felt near the full sized layout. As noted above, the progressive game layout 214 may be a substantial replica of the larger conventional game wagering layout 208. The reduced replica 214 of the conventional layout 208 may be used and located appropriately with respect to the large chart. Moreover, for greater convenience to the dealer and for other reasons, which will become apparent, and in a more preferable embodiment, the scaled down chart may be located adjacent to the larger one in a parallel arrangement as shown in FIG. 1. Additionally, since the principle function of the second, smaller layout is to track the betting on the progressive jackpot roulette game, it is possible for the layout to have one of any of several distinctly different designs, so long as all the numbers on the wheel appear also on the progressive jackpot smaller layout. For example, one design might be in the form of adjacent squares forming a long row around the perimeter of a portion of the table.

After all of the bets from every player desiring to participate in progressive jackpot roulette game have been verified and the player's chips have been placed on the progressive jackpot layout, the dealer may announce that progressive jackpot game is closed. The players proceed then to make all bets and standard wagers on the standard roulette table as they desire, and the dealer spins the wheel 204 and shoots the ball. However as noted above, the players may initially bet on the conventional layouts 208 and then bet on the progressive jackpot layout 214 before the wheel is spun.

After the wheel comes to rest, indicating a specific winning number, the dealer places a glass marker or other marker device on the table felt directly above that number on the progressive jackpot layout 214. Another type of marker may be used on the larger conventional betting layout 208 for the standard roulette game. Then, the dealer clears all of the losing bets from both the conventional wagering layout 208 and the progressive jackpot wagering layout 214. Next, the dealer makes the payout(s) on winning bets made on the standard wagering layout 208.

If any player or players have bet same number on the progressive game layout 214 as selected by the roulette wheel, the glass marker remains in place resting on top of the winning chip or chips on the progressive jackpot layout. The glass marker remains in place during the next spin of the wheel.

The chips representing all other losing bets on the progressive layout 214 are cleared from the table by raking and are collected.

The player or players having their chips on the winning number advance to the second round of the progressive jackpot roulette game. A player or players who won in the first round and whose chip or chips remain on the winning number is not required to place a new wager in the progressive jackpot game to continue to play in the jackpot.

When a number chosen by a player on the progressive layout 214 is first selected by the wheel, the chip remains on the winning number and no other player thereafter may select the same number until the spins of the roulette wheel either produce or fail to produce a winning consecutive sequence of numbers. Thereafter, wagers on the progressive jackpot portion of the game, and the entire progressive jackpot game process is repeated. It should emphasized at this point that all of the conventional bets that are made in the regular or conventional roulette game can be made on every spin of the wheel.

However, if the second spin of the wheel results in the roulette wheel selecting the same number as rolled on a first spin, the dealer then may substitute a different marker for the marker used to identify the number rolled on the first spin. For example, a red glass marker for a first used glass marker of another color. In addition to having a color difference, the glass markers may also have a visual configurational and tactile difference to further identify which round of play in the progressive game is in progress. For example, the marker may be in the shape of a numeral such as the numeral 2, for example and may have a specific "feel".

This substitution of one marker for another by the dealer signals to the players and to the casino management or overseer that the progressive game wager has progressed (or advanced) through the second round of the progressive jackpot game. At this point in the play, the dealer may make the casino management aware of the status of play, so that the winning consecutive spin of the wheel may be verified by persons and/or an electronic monitor responsible for so doing. The public and casino management announcements of successive rounds through which a player has progressed may be accomplished by electronic means.

If a number is rolled in the third round which is different from the number rolled on the two previous consecutive spins, all the losing wagers on the progressive jackpot are again cleared from the table and collected by the dealer. Since the chips are all of unit value amount, a counting device need only count the number of chips to tabulate continuously the amount accumulating in the jackpot fund. Counting is done electronically by a conventional chip counter. Data from the counter is registered in the computer memory 212, from which it can be manipulated by appropriate software to portion out winnings in various rounds of the progressive game, to monitor the amount in the payout jackpot and in a second, residual jackpot fund maintained for the purpose of giving the house the ability to introduce new money into the payout jackpot if such jackpot becomes suddenly depleted by a final round. Of course, in a preferred embodiment a counter need not be used in the dealer collection process of losing conventional bets in the present invention because only player participation in the progressive game results in tabulating the progressive jackpot fund.

However, if the same number is again rolled on the final spin (preferably the third spin) in a series in which the two consecutive previous spins produced the same number, the progressive jackpot total, or specified fraction thereof, is paid to the player or players who selected the number that was rolled three consecutive times. In the case where more than a single player bets on the same number, the jackpot is shared equally between all winners.

Should the jackpot be won, a replacement or residual jackpot fund preferably will automatically seed or partly replenish the jackpot fund to maintain player interest in continuing to play roulette. The replacement jackpot fund may be funded from either a portion of all player contributions, or by a fixed or percentage amount dictated by the casino. The proportions of payout and retention may easily be automatically and continuously controlled by the house using conventional computer programs or special utility software.

The house may have payouts on the winning number at each level of the jackpot game. For example, there may be a small payout for winning the first jackpot roll. This player when winning the second round may then receive another relatively small payout. This player when winning the final round would receive a very large percentage of the total fund because of the high odds against consecutive winning with the same number. For conventional U.S. playing, the odds against winning on two consecutive spins are $38^2$:1, for three consecutive spins $38^3$:1, and on four consecutive spins $38^4$:1.

There are essentially two different wheel designs used in commercial casinos throughout the world. The British and European wheels typically have 36 numbers and one zero, or 37 possible outcomes, while the American version has 36 numbers, a zero and two zeros (0 and 00), or 38 possible outcomes.

Electronic means, standard in the art and commercially available, may be used for tabulating jackpot totals and displaying same on a visual or audio-visual display panel, visible and/or heard by players and non-players near the tables or in the casino. For example, one such supplier and manufacturer of displays is Dynamic Displays, Inc., 3435 E. 44th St., Tucson, Ariz. Known devices such as optical and electronic detecting means, scanners, laser means and/or electromagnetic means associated with appropriate electronic circuits and switching devices, programmable computer central processing units, memories, and the like may be used to make embodiments of the present invention operate efficiently and easily. Electronic, computing and also display components for the embodiments disclosed herein are available from Grips Electronic Gas. m.b.H.; Mariatroster Strasse 41; A-8043 Graz, Austria.

However, a specific aspect of the present invention involves the display and broadcasting to interested persons in a casino and elsewhere that progressive jackpot rounds have advanced through different levels, and that a potential winner at some specific location is becoming eligible to win a jackpot. Such broadcasting can be carried out by the display board 202 reversing itself from light indicia on dark background to dark indicia on light background or visa-versa. It is believed that in no other casino game is there a provision for announcing and broadcasting the fact of a potential winner. Typically, such an announcement occurs only after a player has won an award or jackpot. Such broadcast or announcement may be affected by using a computer and related electronic equipment. Moreover, such a broadcast, prior to a possible winning number jackpot, would create further interest among casino customers.

Further, the roulette tables in any one casino may be electronically linked together so that jackpot build up includes more than one table in a casino. Moreover, electronic link-ups or networks from multiple tables and from multiple casinos situated at locations distant from each other may be used or employed to further increase the number of participating players and the size of the jackpot.

Figure 2:
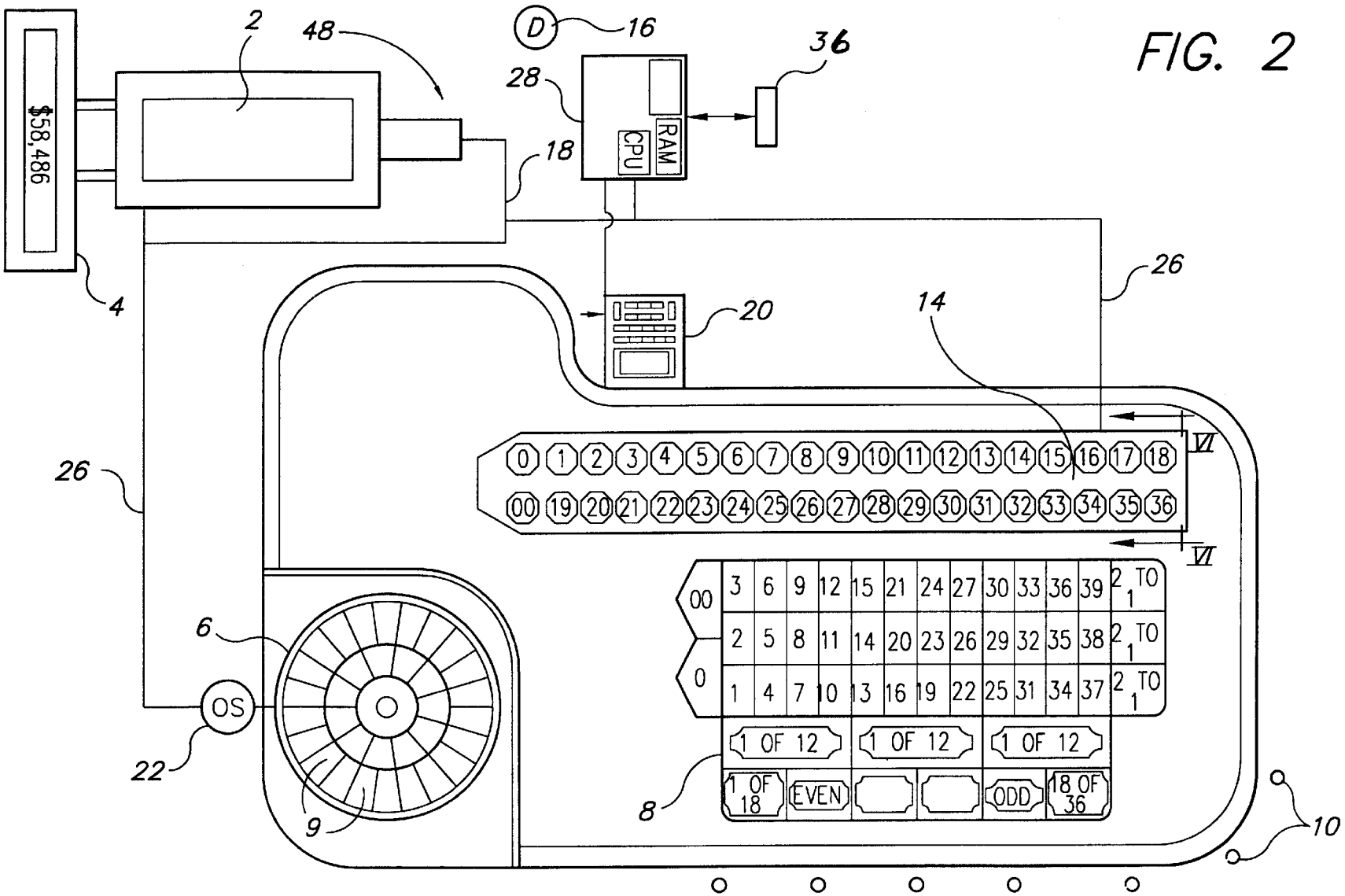
FIG. 2 is a top view of another embodiment of a roulette table having apparatus for playing a progressive jackpot roulette game including associated electronic means for tabulation, accounting, display and communication.

With reference to FIG. 2, there is shown another embodiment of a roulette game with progressive jackpots in accordance with the present invention. This embodiment is operated in a manner that is functionally similar to the tables of FIG. 1, and play is essentially the same. The roulette table comprises a wheel 6 and a conventional betting layout 8. In addition to the conventional betting layout 8, a progressive jackpot betting layout 14, smaller in size than the conventional wagering layout, is placed on the table felt. The dealer typically is positioned at 16, and the players take positions at player positions 10 generally across the table from the dealer.

The progressive jackpot layout need not be a design indicated by 14 in FIG. 2. It may have other shapes and designs such as a race-track loop. A consideration regarding the design of the progressive jackpot layout is that it should be one that allows the dealer to efficiently clear the progressive jackpot wagering layout of the losing bet chips without interfering with the chips or indicator markers placed on the winning numbers.

Following the spin of the wheel and the production of a winning number, the losing chips must be cleared from the table from both the conventional betting layout 8 and the jackpot layout 14. Accordingly, it is advantageous to have the progressive jackpot layout 14, raised slightly above the table surface, e.g., from ¼ to ⅜ inches, to allow raking of losing chips from the conventional wagering layout without interfering with the chips placed on the progressive wagering layout.

As discussed above, a player may simply deliver a single chip by hand to the dealer, who then places it on the selected number on the progressive jackpot layout 14, or the player may place the chip directly on the selected number on the progressive jackpot layout 14. When the dealer directly receives the chips, the dealer may register the number of chips played on the progressive layout into a keypad or input device 20 which transmits data to a computer 28 for processing. The dealer then places these chips on the bet numbers on the jackpot layout 14.

Other means for indicating to the house that a player is playing the progressive game include electronic, weight, radiation and IR sensitive sensors or any other type of sensors located directly under the number positions in the progressive jackpot betting layout. In another embodiment, a player's indication to play in the progressive jackpot game is be made by the player (or the dealer) placing a chip on the progressive jackpot layout 14 beneath which are electronic sensing devices and associated electronic apparatus for detecting or sensing the presence and location of the chip(s). The sensors generate signals in response to a chip being placed on the numbers of the progressive jackpot layout.

After a player has indicated an intention to play in the progressive jackpot and the dealer has come into possession of the progressive jackpot chip, or a chip has been sensed as being placed on a specific jackpot number, or after a progressive jackpot bet has been electronically registered, a display light (such as FIG. 1, 402) optionally located adjacent to each player's position is activated.

Figure 7:
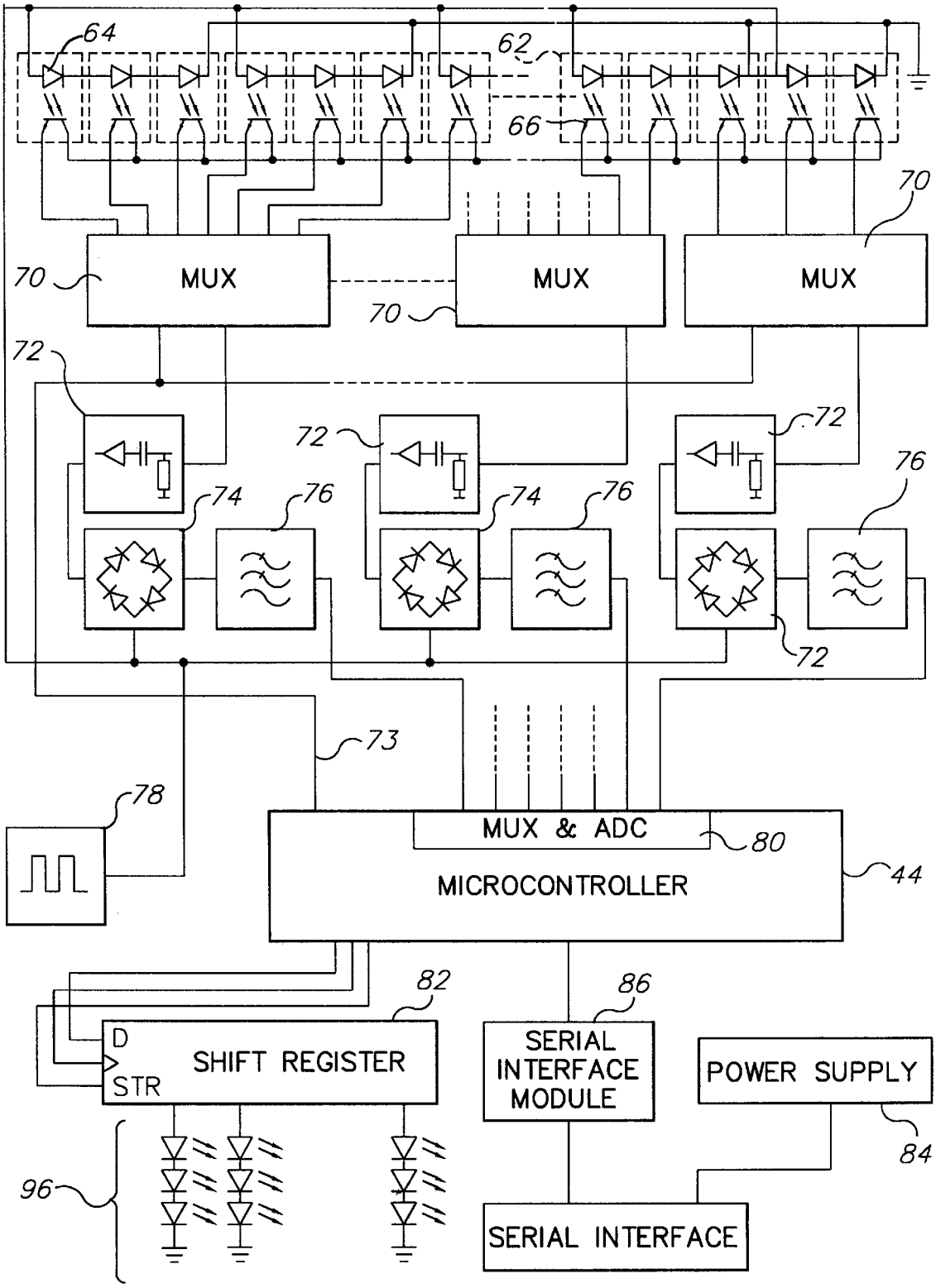
FIG. 7 is a schematic diagram showing circuitry and components relating to an array of the optical sensors beneath the numbers on the progressive jackpot betting layout.

A preferred embodiment of the present invention includes electronic means for operating the game. Referring to FIG. 2, reference numeral 4 is a progressive jackpot display, 2 is a roulette display (SD16), 22 an optical reader, and 28 is a table-controller. The progressive jackpot layout 14 has an has underlying sensor fields 62 (FIGS. 5&7). The number indicated by the resting ball on the roulette wheel is detected by the optical reader 22 and sent to the table-controller 28 by a global table bus (T-BUS) 26. Each number so read is stored in the memory of the table-controller 28 and also is displayed on the roulette display 2. The progressive jackpot display 4 is mounted above the roulette game display 2, and is controlled or operated through a display controller 58 of the SD16 roulette display 2 and a 20-pin flat ribbon cable 56 shown in FIG. 4. The table-controller 28 causes the jackpot display 4 to display an increase in the jackpot with every lost bet. The bets on the progressive jackpot betting layout 14 are sensed and sent over T-BUS line 26 and stored in the on-board memory of the table-controller 28. If more than one player places chips on the same number in the progressive jackpot betting layout 14, the dealer must correct the number of the detected chips by using the dealer input pad 20.

Figure 4:
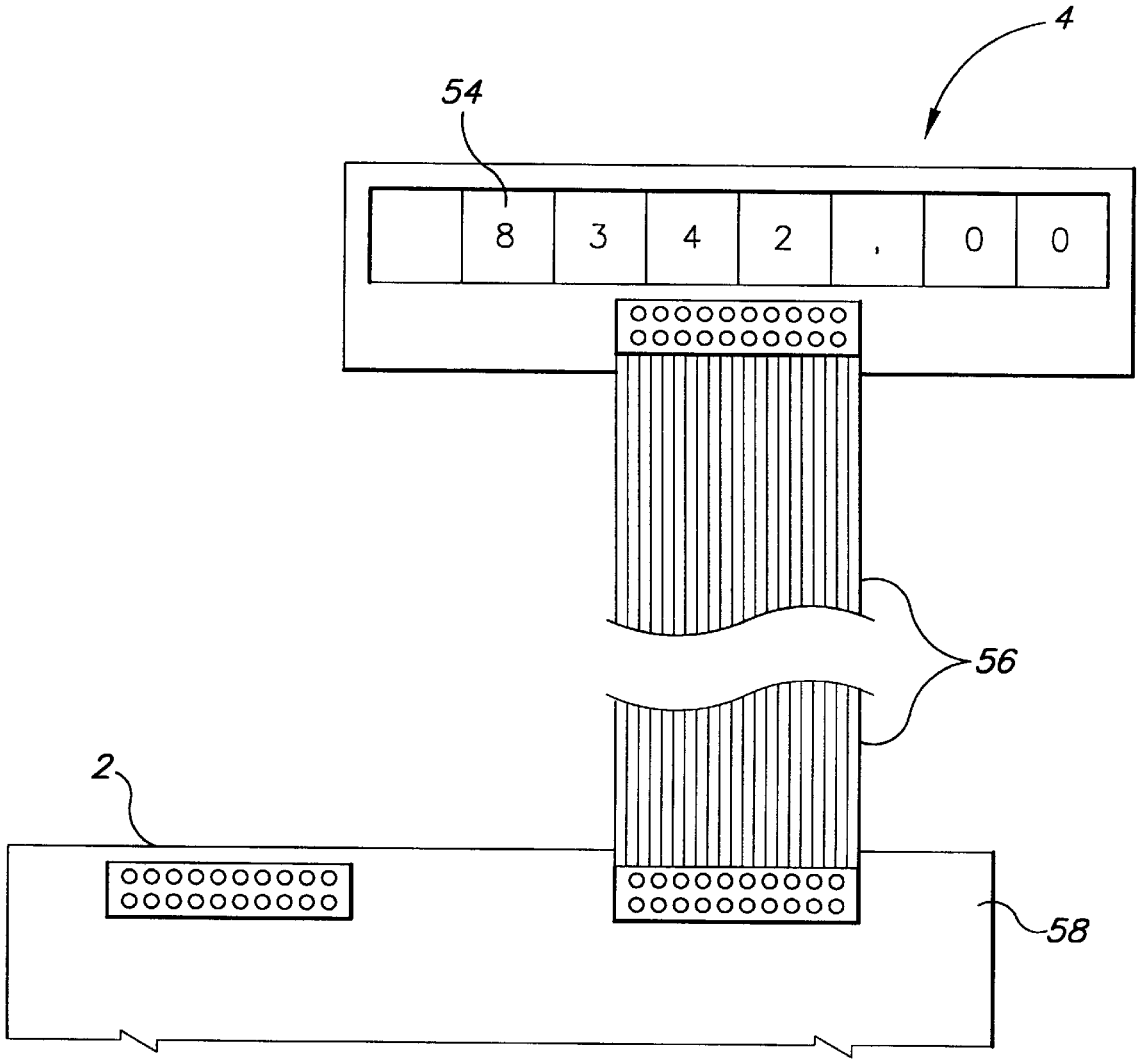
FIG. 4 is a view of an electrical connection between a table-controller and a display board used in embodiments of the present invention.
Figure 5:
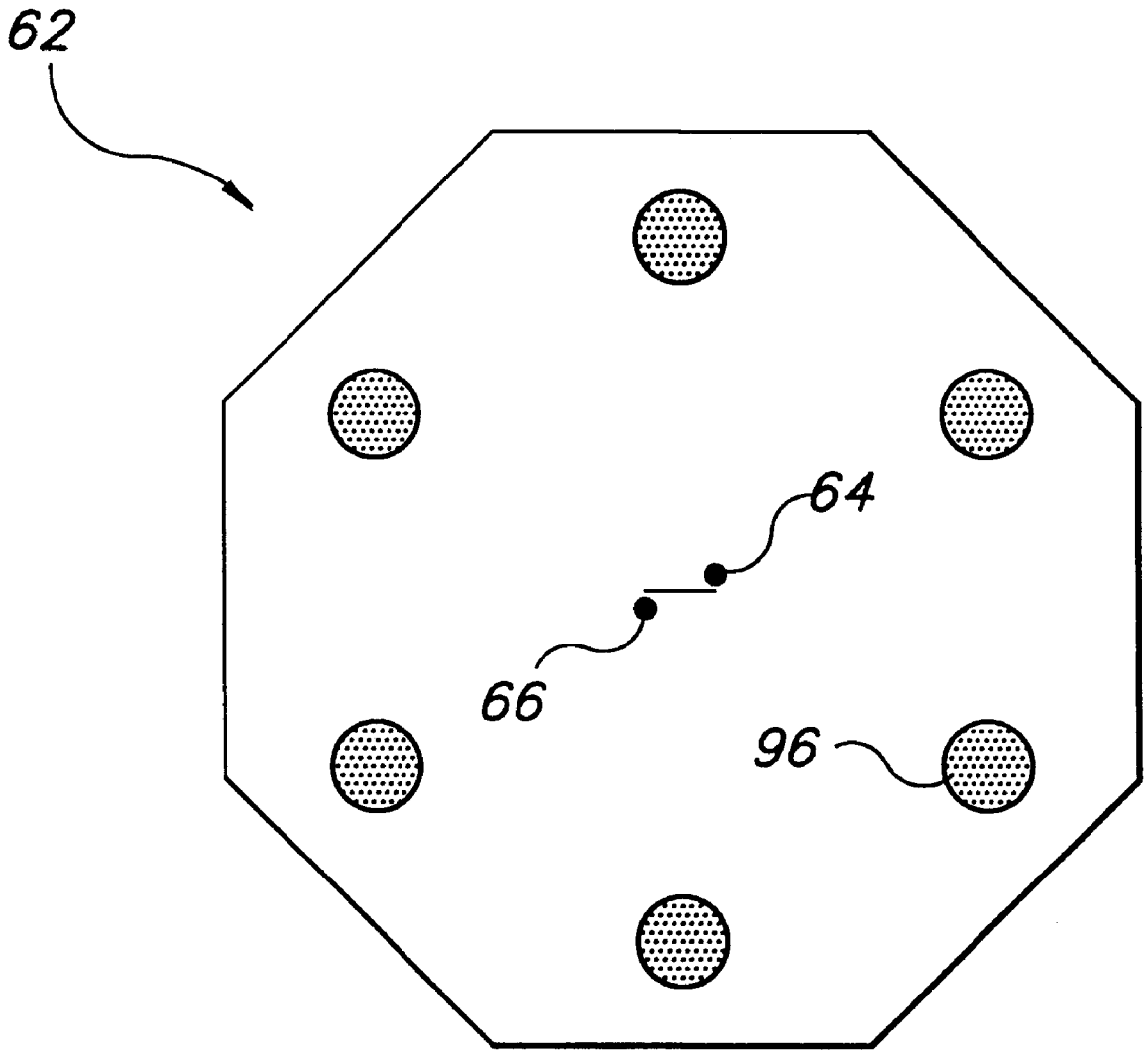
FIG. 5 is a diagrammatical view of an optical sensor device positioned beneath each number for detecting the presence or absence of a chip on the progressive jackpot betting layout.

The progressive jackpot display 4 comprises an 8×64 pixel matrix 54 in FIG. 4, and displays the actual value of the table's progressive jackpot. The microcomputer in the table-controller 28 is programmed to increase the jackpot value displayed whenever bets made on the progressive jackpot layout field lose. In this case, data are sent to the roulette display controller 58 for the roulette display 2 (SD16) through T-BUS 26 and displayed on the progressive jackpot display 4 which is connected to the display controller 58 (FIG. 4) with the 20-pin connector flat ribbon cable 56. If a player has bet on the number selected by the ball and wheel rotation, the dealer places a marker, such as a glass marker, on the winning number on the progressive jackpot layout 14. If the same number wins again on the next spin, a payout is optionally made, and if the same number also wins on the third successive spin, a jackpot is paid out to the appropriate player or players.

The roulette display 2 shows a predetermined number of preceding winning numbers (for example 16). Whenever a winning number is determined by the wheel two or more times in succession, that number is highlighted by color inversion and/or flashing. Communications from the optical reader 22 and the jackpot layout 14 to the table-controller 28 pass through the T-BUS 26 (RS485).

After the ball rests in a pocket 9 on the wheel, an optical reader 22, conventional in the art, detects the number registered by the ball. Following two spins of the wheel and ball to avoid false readings by seeing transient states caused by the ball falling into a numbered pocket, the reader transmits a coded signal to the table-controller 28, and the table-controller 28 stores the number in memory, and compares the number to the stored numbers of the bets made on the progressive jackpot betting layout 14. This control guarantees that payout to an invalid win will not be made, or that the dealer will not accept a bet made late on a winning number. An alarm (not shown) will sound in the event of a failed comparison.

Figure 3:
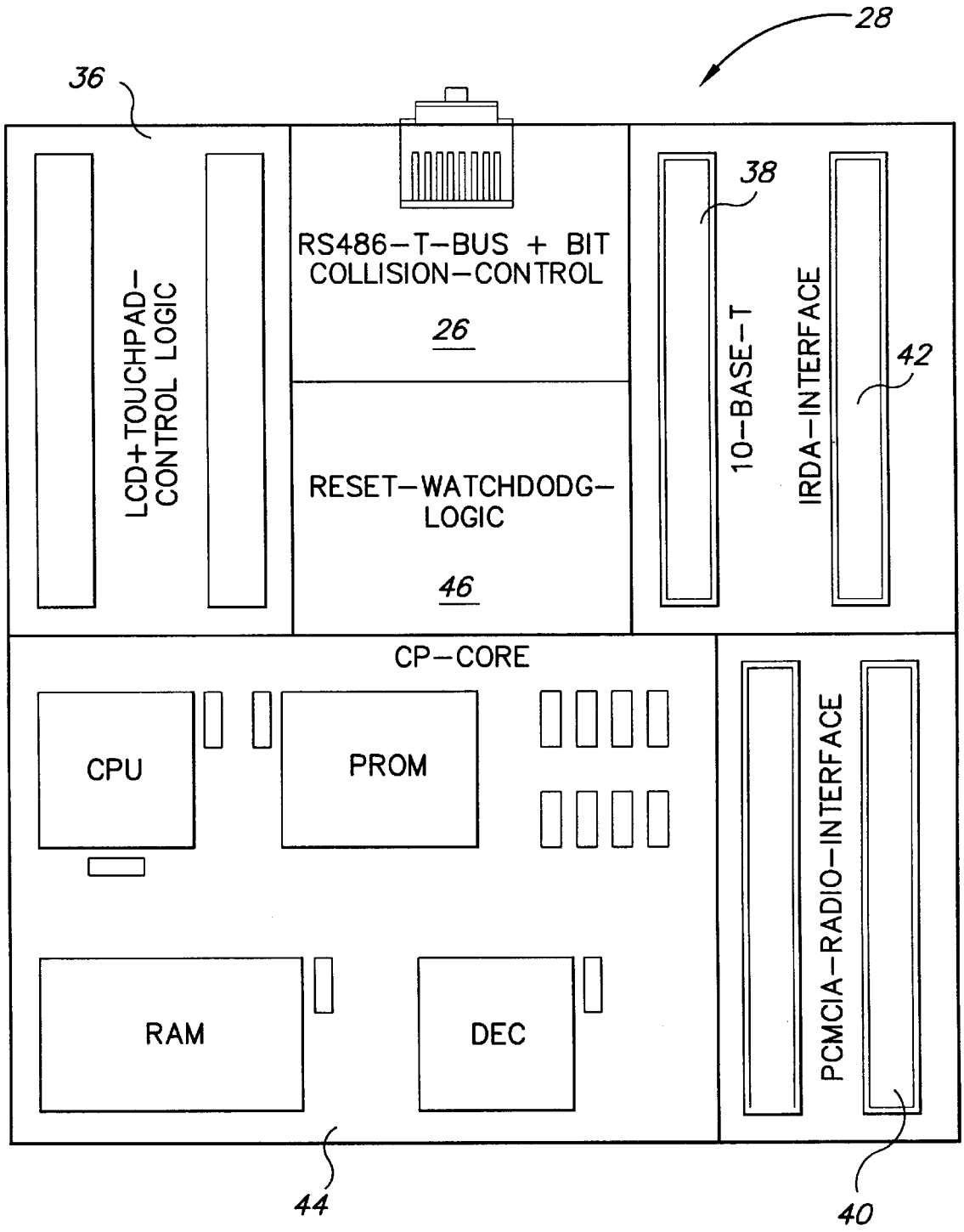
FIG. 3 is a block diagram of an electronic table-controller for use in embodiments of the present invention.

An embodiment of the table-controller 28 is shown in FIG. 3, and it controls sending and storing data throughout the system. It functions as a server controller via a 10-Base-T 38, radio transmission 40 or IRDA 42. The table-controller 28 includes a CPU kernel 44,46 with watchdog, powerfail, decoding logic, and a memory for storing all needed data. The table-controller 28 through a touch-terminal 36 also controls an optional graphic display and touch pad (not shown) and the touch-pad 20 that is used by the dealer to input data. The T-BUS 26 connects to the table-controller 28 through a RS485-Interface.

Figure 6:
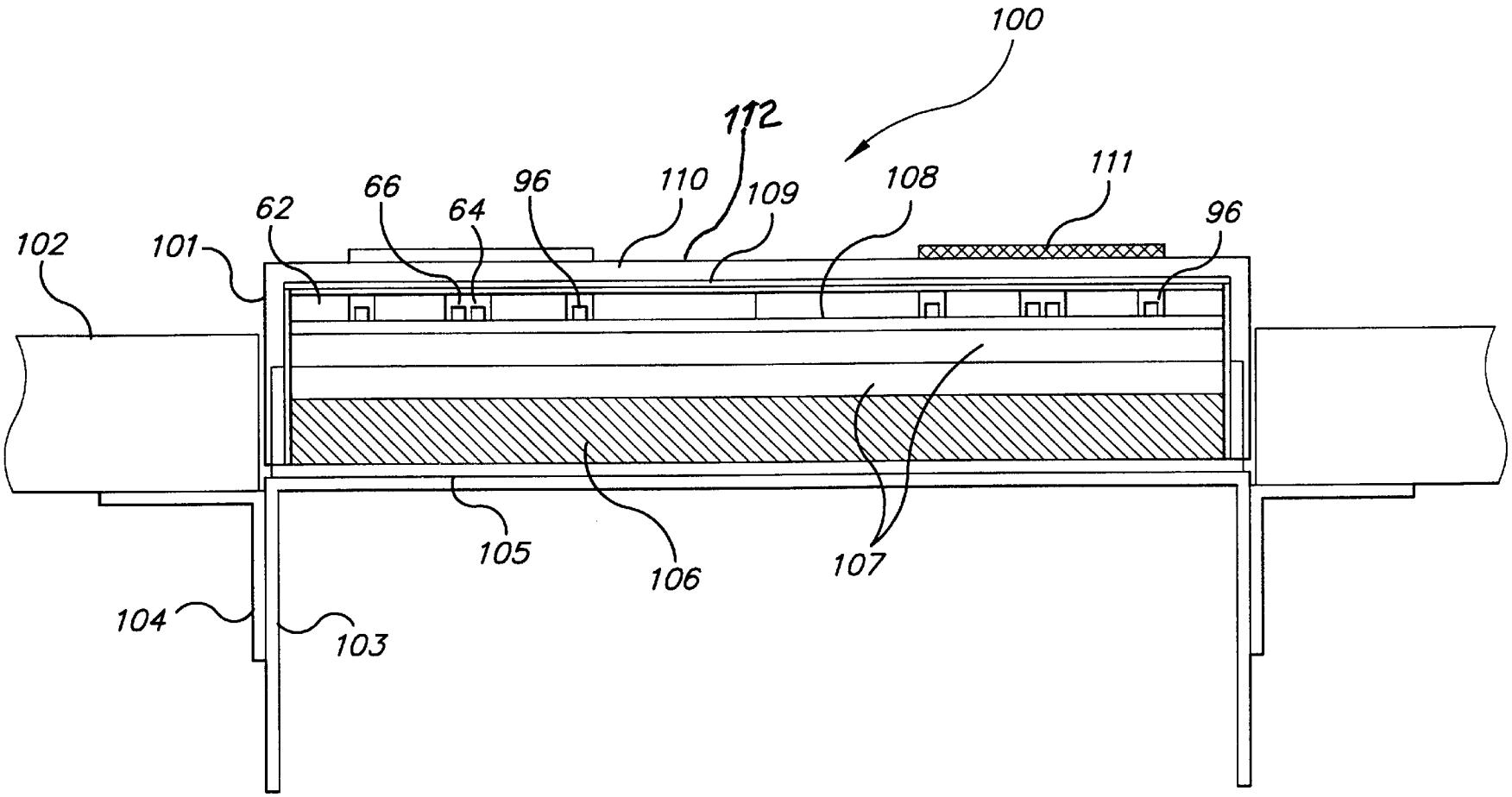
FIG. 6 is sectional view taken along line VI—VI of FIG. 2 of the progressive jackpot betting layout and the underlying optical sensor devices in accordance with the present invention.

Each number position on the progressive jackpot layout defines a field, and a sensor 62 (FIGS. 5 to 7) is located under each field. As shown in FIG. 6, the progressive jackpot layout is a rectangular insert 100 located in a cutout portion 101 of the table top 102. The insert 100 is located on a mounting plate 103 that is secured to the table top 102 by mounting brackets 104. The insert includes a ground plate 105, foam rubber 106, and two spacer plates 107. A layer of PCB 108 holds the sensors 62 and the components of the sensors upwardly into holes formed in a background light distributing plate 112. A foil 109 has the progressive jackpot layout numbers printed thereon, and the insert is enclosed by a plexiglass cover 110. A chip 111 is shown resting on number position "18" on the progressive jackpot layout.

The sensors 62 each have an infra-red transmitter 64 and receiver 66. Whenever one or more chips are placed on a number field 216, six light emitting diodes (LED) 96 begin flashing about the number to signal to the dealer and other players that the number was chosen for progressive jackpot play. The numbers represented by the individual fields are stored in the memory of the table-controller 28. If necessary, the dealer uses the input pad 20 (FIG. 2) to input to the table-controller 28 the correct number of chips placed on a field, and thus indicating that there are different players playing the same number. The microcomputer of the table-controller 28 is programmed to cause the LEDs 96 of the field sensor 62 to flash rapidly when the number selected by the wheel matches one of the player selected progressive jackpot numbers, and the LEDs for all other bet numbers are switched off. The dealer places a marker over the number with the flashing LEDs 96.

The sensors 62 illustrated in FIGS. 5 to 7 and used for chip detection are reflective object sensors which are located beneath each bet field. To reduce the influence of ambient light, modulated infrared radiation is used. The modulation frequency is provided by a clock generator 78, which is used to drive the infrared emitter diodes 64 of the reflective object sensors 62. The receivers (phototransistors 66) which pick up the reflected IR-light are connected to a detection circuit 72,74,76 via a multiplexer 70. The first stage of the detection circuit is a preamplifier with a high pass filter 72, which filters out the DC-component caused by the ambient light. The amplified signal is passed to a synchronous demodulator including a mixer 74 and a low pass filter 76, which converts the modulated signal into a DC voltage. The output signals of the demodulators are measured with an internal A/D converter 80 of the microcontroller 44.

To reduce the multiplexing rate of the analog circuity and thus to increase the scanning speed, several demodulator circuits are used in parallel. The microcontroller 44 generates the multiplexer control signals 73, measures the signals from the reflective object sensors 62 and compares them to internally stored thresholds to decide whether or not a chip is on the corresponding bet field.

In summary, the reflective object sensor consists of two separate elements, an infrared emitting diode 64 and a phototransistor 66, both in a PLCC-2 package. This package was chosen, because it has a solid opaque body with a window on top. It offers relatively good optical decoupling (the light from the transmitter does not shine directly into the receiver), when two elements are placed side by side. These elements are standard components, available from various manufacturers such as Siemens or Temic. This sensor resides in a hole in the light distribution plate, as shown in FIG. 6.

The IR-LEDs are constantly emitting modulated IR light (modulated by the clock generator 78). The light shines through the foil 109 and the plexiglass cover 110. The intensity of the reflected light is measured via the phototransistors 66. If a chip lies on the sensor, the intensity of the reflected light increases.

The detector uses a synchronous rectifier, which consists of a mixer 74, driven by the own clock signal and low pass filter 76. This circuit converts the components of the input signal with equal frequency and zero phase shift to the own clock into a DC-voltage.

Components of different frequency are mixed to a frequency equal to the clock and their own frequency. If the difference is high enough, the residual frequency is filtered out by the low pass filter. For this reason, the light of the blinking LEDs (much slower than the modulation frequency) can cause no serious interference.

The microcontroller 44 also has to manage the serial communication via the Table Bus. To keep the interface flexible, a replaceable interface module 86 is used. The indicator LEDs 96 which are placed around each bet field are driven by a shift register 82 that is controlled by the microcontroller 44.

Figure 8:
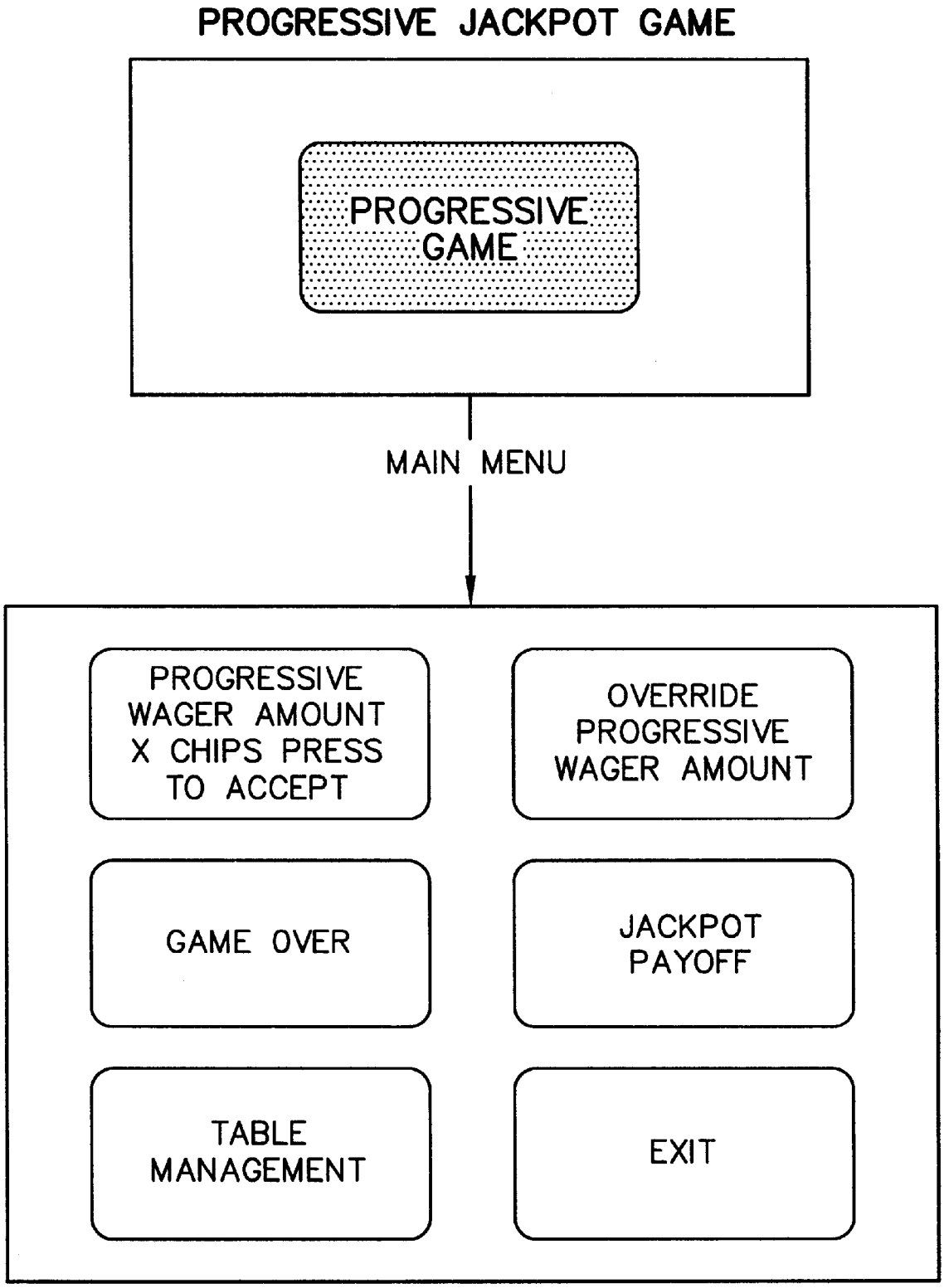
FIGS. 8 to 12 show the screens and corresponding flow diagrams for an input pad through which the dealer manages a roulette table in accordance with the present invention.
Figure 9:
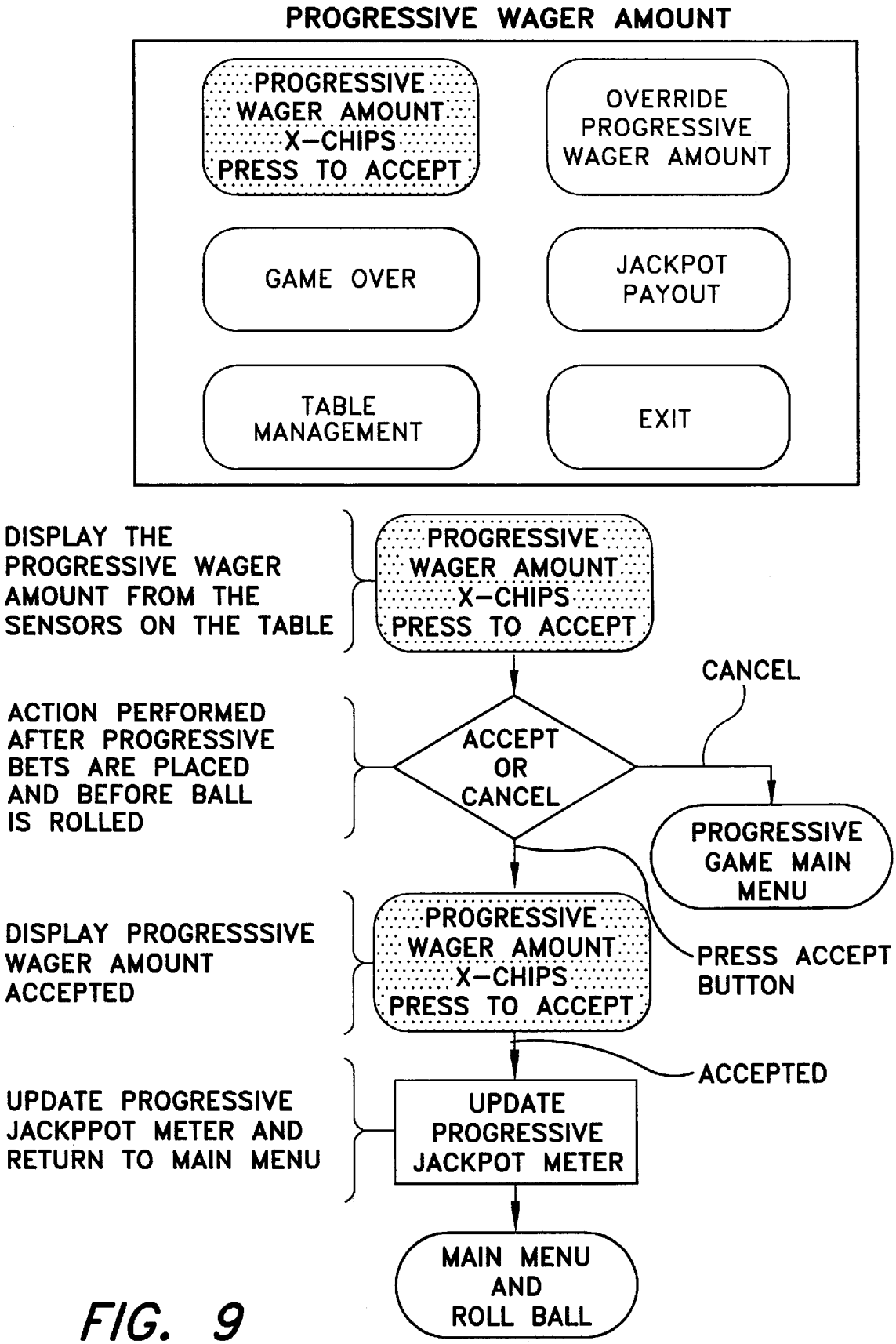

With reference to FIGS. 8 to 12, there is shown the various options that the dealer has for managing the table with the input pad. Choosing "Progressive Game" on the initial menu raises the Progressive Jackpot Main Menu which has 6-options as shown in FIG. 8. The options are:

(1) Progressive Wager Amount-Press to Accept is used when the wager amount detected by the sensors is accepted and used to update the jackpot meter as shown in FIG. 9.

(2) Override Progressive Wager Amount selection is used when the wagered amount detected by the sensors is corrected by the dealer, e.g., because there has been more than one bet on at least one number. The corrected value is used to update the jackpot display or meter.

(3) Game Over normally acts as a display. It is highlighted when the optical reader detects a number on the roulette wheel to show that the system has detected the end of the game. If a jackpot has occurred, the dealer has to press the Jackpot Payout key to confirm the jackpot. If the optical reader does not detect a number for any reason, the dealer needs to press the Game Over key to end the game manually. This will bring up another screen, where the dealer has to enter the current winning number. This is necessary, because the Table Management functions, which also contain a key to enter the last number, normally would not be accessible by the dealer.

Figure 10:
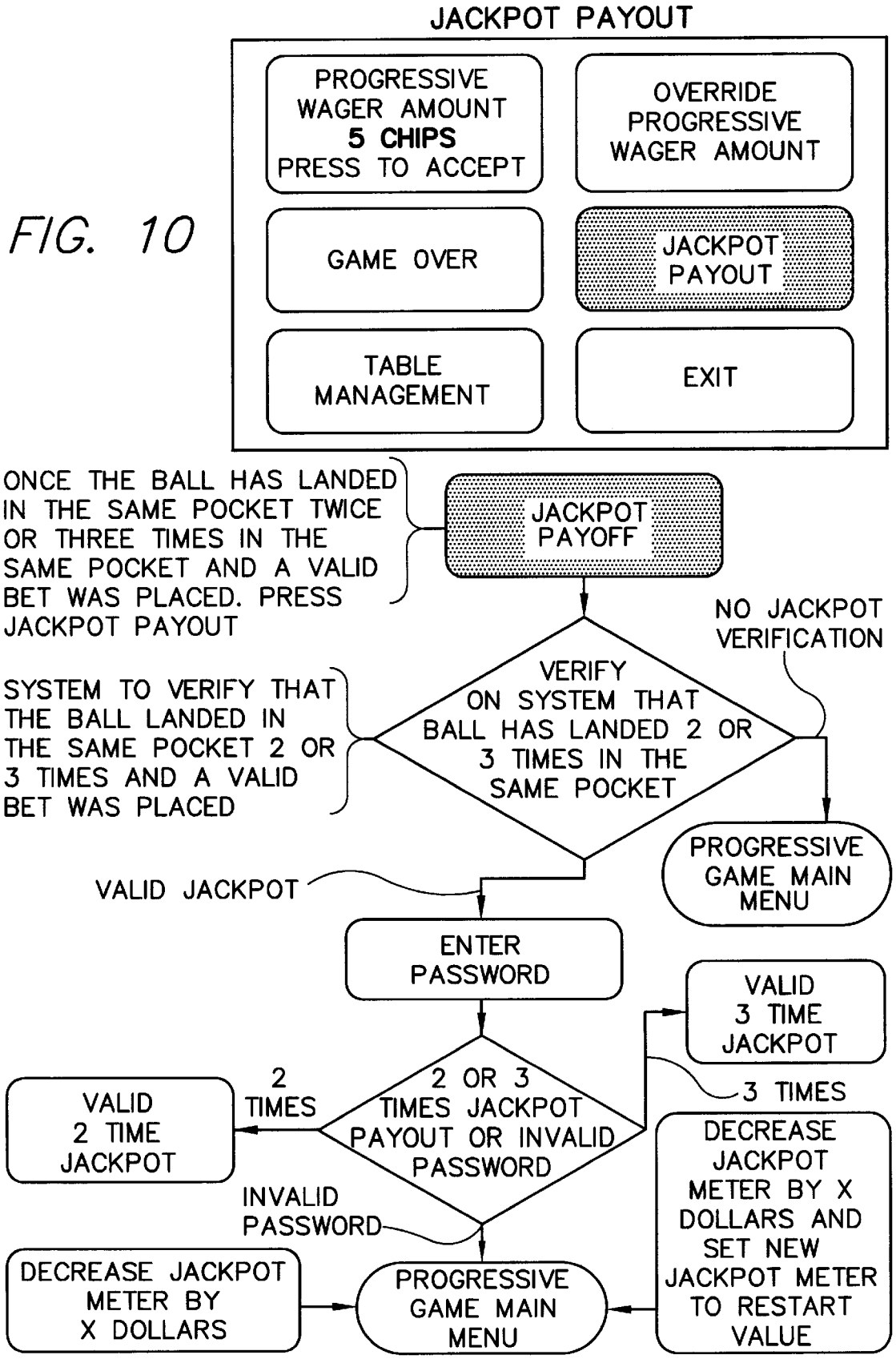

(4) Jackpot Payout shown in FIG. 10 is used to verify and authorize a jackpot payout after two and three successive same number selections by the roulette wheel.

Figure 11:
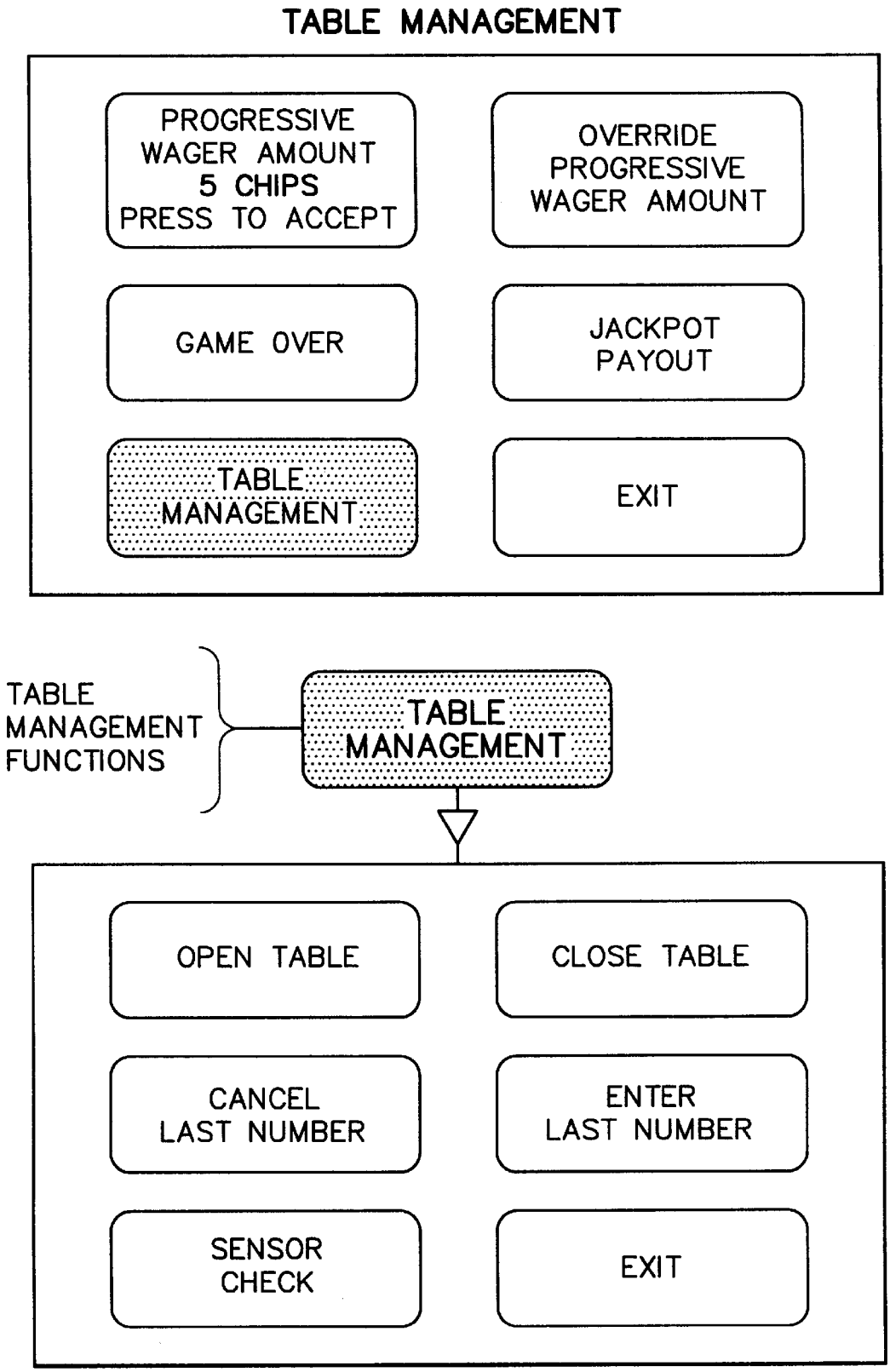
Figure 12:
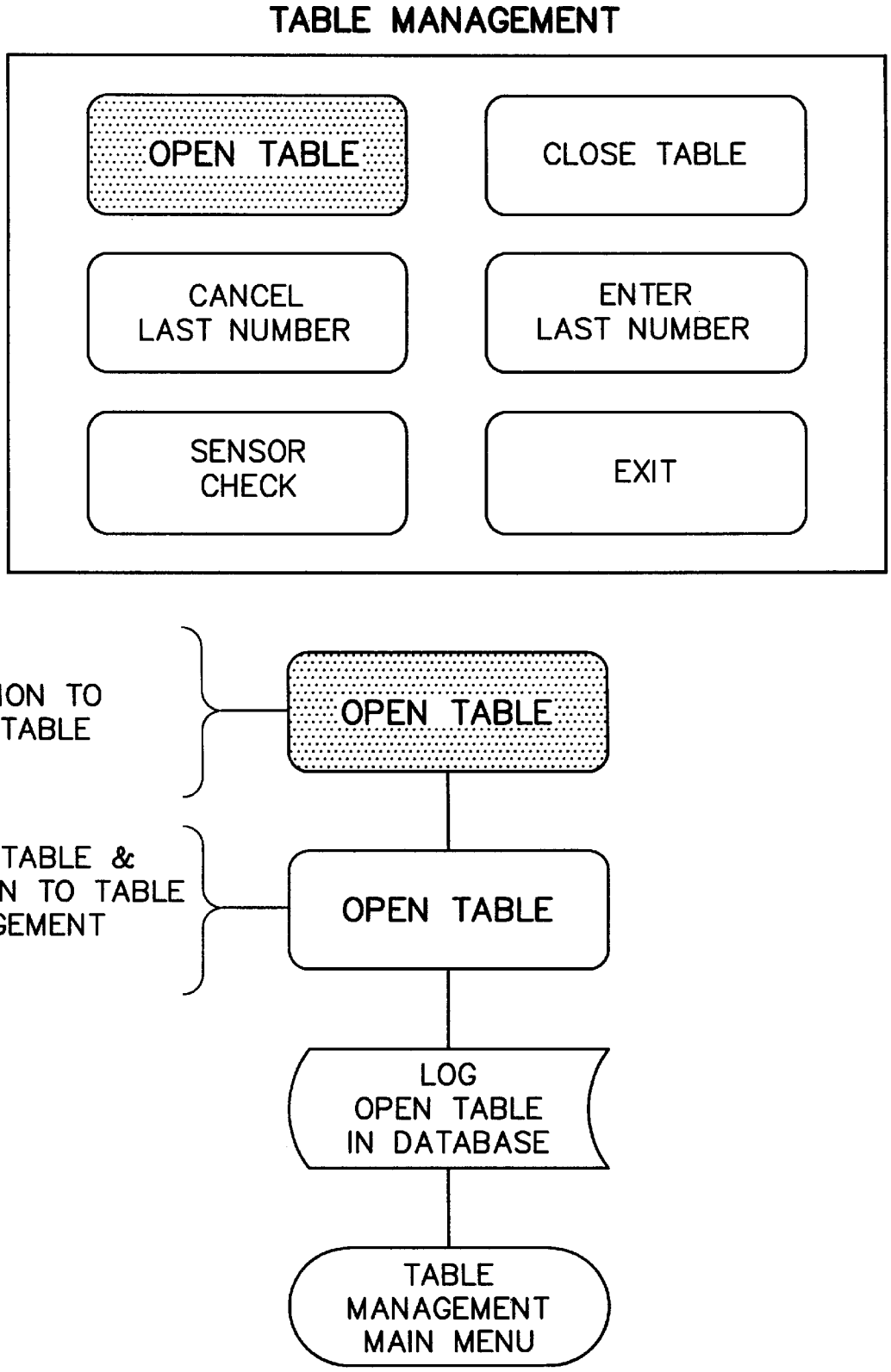

(5) Table Management when selected as shown in FIG. 11 opens a sub-menu displayed in FIG. 12. The sub-menu provides access to functions for opening and closing the table, correcting false detections of the optical reader, and checking and calibrating the sensors in the bet field. The Open Table function opens the table for gaming, generates a log entry, and makes the gaming functions of the Progressive Jackpot menu of FIG. 8 accessible. The Close Table function disables all functions (except service functions such as "Sensor Check"), and generates a log entry.

(6) Exit selection is used to return the screen to Progressive Game shown in FIG. 8.

As discussed above, a jackpot fund preferably is accumulated solely from the amount wagered on the progressive jackpot betting layout. As used herein, "accumulated solely" contemplates optionally initially seeding the jackpot fund with a predetermined amount of funds after each jackpot payout, and thereafter accumulating the jackpot fund solely from the amount wagered on the progressive jackpot betting layout.

The roulette table itself may be replaced by a slot machine and computer device, or may comprise a hybrid live game and electronic game.

Thus while the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. A method of playing roulette with a system including (i) a single means for selecting a number from a predetermined group of numbers, (ii) a first betting layout for playing a conventional game of roulette, said first betting layout having thereon a plurality of numbers corresponding to said predetermined group of numbers, and (iii) a second betting layout for playing a progressive jackpot game, said second layout having thereon the same plurality of numbers as are on said first betting layout; said method comprising the steps of:

(a) players making wagers on any number on at least one of (i) said first betting layout to participate in a conventional game of roulette, (ii) on said second betting layout to participate in a progressive jackpot game and (iii) on said first betting layout and said second betting layout said progressive jackpot game being won by a same wagered number being selected by said number selection means for a predetermined number of successive operations of said number selecting means;

(b) operating said number selecting means to select a winning number;

(c) marking the winning number on said second betting layout for preventing the marked winning number from being further wagered until the occurrence of one of (i) a different winning number is selected in step (b) to break the order of successive same number winnings, and (ii) the jackpot is won by the same number winning for said predetermined number of successive operations of number selecting means; and any unmarked number on said progressive jackpot betting layout being bettable before each operation of said number selecting means;

(d) paying any winning wagers on said first betting layout;

(e) accumulating a jackpot fund from a portion of said wagers; and (f) repeating steps (a) to (e) until said same wagered number in said progressive jackpot game is selected by said number selecting means for said predetermined number of successive operations.

2. The method of claim 1 wherein said number selecting means is a roulette wheel and ball.

3. A method of playing roulette on a roulette table which comprises a top surface configuration including (i) a roulette wheel and ball, (ii) a conventional betting layout with a plurality of numbers thereon corresponding to the numbers on the roulette wheel, and (iii) a progressive jackpot betting layout having thereon the same plurality or numbers as are on the conventional betting layout, said method comprising the steps of:

(a) players making wagers on the conventional betting layout to play a conventional game of roulette;

(b) players making wagers on the progressive jackpot betting layout to participate in a separate progressive jackpot game wherein the jackepot is won by a same wagered winning number coming up for a predetermined number of successive spins of the wheel;

(c) a dealer spinning the wheel, shooting the ball and identifying the location of the ball on the wheel at the end of the spin to determine a winning number;

(d) the dealer marking the marking the winning number on the progressive jackpot betting layout with a marker;

(e) accumulating a jackpot fund from the amount wagered;

(f) the dealer clearing all losing wagers from the conventional betting layout, and leaving only winning wager (s) on the conventional betting layout;

(g) the dealer clearing all losing wagers from the progressive jackpot betting layout, and leaving only winning progressive wager(s) on the progressive jackpot betting layout;

(h) the dealer paying any winning wagers on the conventional betting layout;

(i) the dealer removing the marker from the progressive jackpot betting layout if there is no winning wager on the progressive jackpot layout in step (c);

(j) if there is a winning wager on the progressive jackpot betting layout in step (c), the dealer leaving the marker on the marked number an the progressive jackpot betting layout to prevent the marked number on the progressive jackpot betting layout from being further wagered for the next spin, the marked number on the progressive jackpot betting layout not being further wagered until the occurrence of one of (i) a different number wins in step (c) to break the order of successive same number winnings and (ii) until the jackpot is won by the same number winning for said predetermined number of successive spins of the wheel;

(k) repeating steps (a) to (j);

(l) if the spin of repeated step (c) produces the same winning number in succession, the dealer leaves the marker on the winning number on the progressive jackpot betting layout or substitutes another distinctive marker to indicate that the winning number has now been rolled in succession; and (m) if necessary, repeating steps (a) to (l) until the same wagered winning number in said progressive jackpot game comes up for said predetermined number of successive spins of the wheel, whereupon the jackpot fund is paid out.

4. The method of claim 3 wherein the jackpot fund is initially seeded with a predetermined amount of funds after each jackpot payout.

5. The method of claim 3 wherein said predetermined number of successive spins is three.

6. The method of claim 3 wherein the jackpot fund is accumulated from a predetermined percentage of the amount in step (e) wagered on the progressive jackpot betting layout.

7. The method of claim 6 wherein a second jackpot fund is accumulated in step (e) to provide an intermediate payout whenever the same wagered winning number comes up for a second predetermined number of successive spins of the wheel that is less than said predetermined number of successive spins.

8. The method of claim 3 wherein said roulette table further comprises a number of player positions, and an equal number of mutually distinctive sets of chips with each chip having the same value, and each player is assigned a different one of the sets as a source of chips; and wherein in step (b) each player may bet on one or more numbers on the progressive jackpot betting layout, but each player is limited to a single chip wager on each number bet on the progressive jackpot betting layout.

9. The method of claim 3 wherein said roulette table further comprises a number of player positions, and an equal number of mutually distinctive sets of chips with each chip having the same value, each player is assigned a different one of the sets as a source of chips, and each set of chips having valued chips and non-valued chips; and wherein in step (a) each player uses valued chips to bet on one or more numbers on the conventional betting layout, and in step (b) each player may bet on one or more numbers on the progressive jackpot betting layout, but each player is limited to a single non-value chip wager on each number bet on the progressive jackpot betting layout.

10. The method of claim 3 wherein bets are initially placed on either the conventional or progressive jackpot betting layouts.

11. The method of claim 10 wherein bets are initially placed on the conventional betting layout, and then on the progressive jackpot betting layout.

12. The method of claim 3 further comprising sensing beneath the progressive betting layout to determine bet progressive jackpot numbers, and indicating to the dealer bet progressive jackpot numbers.

13. The method of claim 12 further comprising displaying the amount of money in the jackpot fund, and the number of successive same number winnings by a player.

14. The method of claim 3 wherein only players playing in the conventional game of roulette are permitted to optionally make wagers on the progressive jackpot betting layout, and wherein the dealer also marks the winning number on the conventional betting layout with another marker, the dealer also removing said another first marker from the conventional betting layout in step (i).

15. A system for playing roulette comprising:

a roulette table including (i) a single means for selecting a number from a predetermined group of numbers, (ii) a conventional betting layout with a plurality of numbers thereon corresponding to the numbers on the number selecting means, and (iii) a progressive jackpot betting layout having thereon the same plurality of numbers as are on the conventional betting layout; said number selecting means being operated to play a conventional game of roulette on said conventional betting layout, and to play a separate progressive jackpot game on the progressive jackpot betting layout wherein a jackpot is won by a wagered number winning on the progressive jackpot betting layout for a predetermined consecutive number of operations by said number selection means;

means for generating signals representative of numbers bet on the progressive jackpot betting layout;

means responsive to said generating means for indicating bet progressive jackpot numbers;

means used by the dealer for marking a winning bet number on the progressive jackpot betting layout to prevent the marked number on the progressive jackpot betting layout from being further wagered until the occurrence of one of (i) a different number wins to break the order of successive same number winnings and (ii) until the jackpot in won by the some bet number winning for said predetermined number of operations of said number selecting means;

any number on said conventional betting layout being bettable before each operation of said number selecting means, and any unmarked number on said progressive jackpot betting layout being bettable before each operation of said number selecting means;

means for sensing the winning number on operations of said number selecting means; and means including a computer responsive to said generating means, and said sensing means for accumulating a jackpot fund from a portion of the wagers, and for determining when the same bet number wins for said predetermined number of successive operations by said number selecting means.

16. The system of claim 15 wherein said number selecting means is a roulette wheel and ball.

17. The system of claim 16 wherein said accumulating means accumulates the jackpot fund from a portion of the amount wagered on the progressive jackpot betting layout.

18. The system of claim 16 wherein the signal generating means comprises a sensor beneath each number on the progressive jackpot betting layout for detecting when a chip is placed on the number.

19. The system of claim 16 further comprising the progressive jackpot layout being laterally spaced from and above the conventional betting layout.

20. The system of claim 16 wherein said progressive jackpot betting layout includes a number surface having the plurality of numbers thereon, and said generating means includes beneath each number on said number surface an upwardly emitting signal transmitter and a companion signal receiver; and wherein a chip placed on any one of the plurality of numbers on said number surface reflects the signal from the respective transmitter therebelow to the companion receiver to generate the signal representative of the number being bet.

21. The system of claim 20 wherein said upwardly emitted signal is an infrared wave.

22. The system of claim 16 wherein said bet indicating means include blinking lights beneath each number on said number surface.

23. The system of claim 16 wherein said predetermined number of successive spins is three.

24. The system of claim 16 wherein said roulette table further comprises a number of player positions, and an equal number of mutually distinctive sets of chips, and each player is assigned a different one of the sets as a source of chips; and wherein each player optionally bets on one or more numbers on the progressive jackpot betting layout, and each player is limited to a single chip wager on each number bet on the progressive jackpot betting layout.

25. The system of claim 16 wherein bets are placed on the conventional and/or progressive jackpot betting layouts.

26. The system of claim 16 wherein bets are initially placed on the conventional betting layout, and then on the progressive jackpot betting layout.

27. The system of claim 16 further comprising means beneath the progressive betting layout for detecting bet progressive jackpot numbers, and for indicating to the dealer bet progressive jackpot numbers.

28. The system of claim 16 further comprising means connected to said computer for displaying the amount of money in the jackpot fund, and the number of successive same number winnings.

29. A method of playing roulette with a system including (i) a roulette wheel and ball for selecting a number from a predetermined group of numbers, (ii) a first betting layout for playing a conventional game of roulette, and (iii) a second betting layout for playing a jackpot game; said method comprising the steps of:

(a) players making wagers on any number on said first betting layout to participate in a conventional game of roulette and on said second betting layout to participate in a jackpot game, said jackpot game being won by a same wagered number being selected by said roulette wheel and ball for a predetermined number of successive operations of said roulette wheel and ball;

(b) operating said roulette wheel and ball to select a winning number;

(c) marking the winning number on the second betting layout for preventing the marked number from being further wagered until the occurrence of one of (i) a different winning number is selected in step (b) to break the order of successive same number winnings, and (ii) until the jackpot is won by the same number winning for said predetermined number of successive operations of said roulette wheel and ball; and any unmarked number on said second betting layout being bettable before each operation of said number selecting means;

(d) paying any winning wagers on said first betting layout;

(e) repeating steps (a) and (b) until said same wagered number is selected by said roulette wheel and ball for said predetermined number of successive operations; and (f) providing a fixed value payout after one or more successive wins by the same wagered number on said second betting layout.

* * * * *